US007502020B2

(12) United States Patent
Kim et al.

(10) Patent No.: US 7,502,020 B2
(45) Date of Patent: Mar. 10, 2009

(54) LIQUID CRYSTAL DISPLAY DEVICE WITH VOLTAGE COMPENSATOR

(75) Inventors: Seok Su Kim, Daegu (KR); Hyun Seok Kim, Daegu (KR); Sun Young Choi, Seoul (KR)

(73) Assignee: LG Display Co., Ltd., Seoul (KR)

( * ) Notice: Subject to any disclaimer, the term of this patent is extended or adjusted under 35 U.S.C. 154(b) by 739 days.

(21) Appl. No.: 11/022,652

(22) Filed: Dec. 28, 2004

(65) Prior Publication Data

US 2005/0156840 A1 Jul. 21, 2005

(30) Foreign Application Priority Data

Dec. 30, 2003 (KR) ..... 10-2003-0100655

(51) Int. Cl.
*G09G 5/00* (2006.01)
*G09G 3/36* (2006.01)

(52) U.S. Cl. ..... 345/211; 345/98

(58) Field of Classification Search ..... 345/87, 345/98, 100, 211, 204
See application file for complete search history.

(56) References Cited

U.S. PATENT DOCUMENTS 5,831,605 A * 11/1998 Yasui et al. ..... 345/211
6,466,191 B1 * 10/2002 Choi et al. ..... 345/94
6,646,691 B1 * 11/2003 Watanabe et al. ..... 349/39
6,822,632 B2 * 11/2004 Lee et al. ..... 345/95
6,894,667 B1 * 5/2005 Lin ..... 345/87
7,084,840 B2 * 8/2006 Moon ..... 345/87
7,224,353 B2 * 5/2007 Song et al. ..... 345/211
2001/0011984 A1 * 8/2001 Hong ..... 345/92

* cited by examiner

*Primary Examiner*—Kevin M Nguyen
(74) *Attorney, Agent, or Firm*—McKenna Long & Aldridge LLP

(57) ABSTRACT

A liquid crystal display device and a driving method thereof for preventing a brightness difference between horizontal line blocks are disclosed. In the liquid crystal display device, a liquid crystal display panel has a liquid crystal cell matrix. A power supply generates a common voltage. Common lines directly on a substrate of the liquid crystal display panel are connected to a common electrode of the liquid crystal cell. A common voltage compensator compensates for the common voltage into a large resistance value with a resistance value greater than a combination of resistances of the common lines and the large resistance directly between the power supply and the common lines.

10 Claims, 6 Drawing Sheets

LIQUID CRYSTAL DISPLAY DEVICE WITH VOLTAGE COMPENSATOR

This application claims the benefit of Korean Patent Application No. P2003-100655 filed in Korea on Dec. 30, 2003, which is hereby incorporated by reference.

BACKGROUND OF THE INVENTION

1. Field of the Invention

This invention relates to a liquid crystal display, and more particularly to a liquid crystal display device and a driving method thereof that prevents gravity degradation to thereby improve picture quality.

2. Description of the Related Art

Generally, a liquid crystal display (LCD) controls the light transmittance of a liquid crystal using an electric field to display a picture. The LCD includes a liquid crystal display panel having liquid crystal cells arranged in a matrix, and a driving circuit for driving the liquid crystal display panel.

In the liquid crystal display panel, gate lines and data lines are arranged such that the gate lines and the data lines cross each other. The liquid crystal cell is positioned at each area where the gate lines cross the data lines. The liquid crystal display panel is provided with a pixel electrode and a common electrode for applying an electric field to each of the liquid crystal cells. Each pixel electrode is connected, via source and drain electrodes of a thin film transistor as a switching device, to any one of the data lines. The gate electrode of the thin film transistor is connected to any one of the gate lines thereby allowing the application of a pixel voltage signal to the pixel electrodes for each line.

The driving circuit includes a gate driver for driving the gate lines, a data driver for driving the data lines, a timing controller for controlling the gate driver and the data driver, and a power supply for supplying various driving voltages used in the LCD. The timing controller controls a driving timing of the gate driver and the data driver and applies a pixel data signal to the data driver. The power supply generates driving voltages such as a common voltage VCOM, a gate high voltage VGH and a gate low voltage VGL, etc. The gate driver sequentially applies a scanning signal to the gate lines to sequentially drive the liquid crystal cells on the liquid crystal display panel line by line. The data driver applies a data voltage signal to each of the data lines when the scanning signal is applied to one of the gate lines. Accordingly, the LCD controls the light transmittance by an electric field applied between the pixel electrode and the common electrode in response to the pixel voltage signal for each liquid crystal cell, thereby displaying a picture.

The data driver and the gate driver directly connected to the liquid crystal display panel integrate into a plurality of integrated circuits (IC's). Each of the integrated data drive IC's and gate drive IC's mount in a tape carrier package (TCP) and connect to the liquid crystal display panel by a tape automated bonding (TAB) system. In addition, the integrated data drive IC's and gate drive IC's may mount onto the liquid crystal display panel using a chip on glass (COG) system.

Herein, the drive IC's connected, via the TCP, to the liquid crystal display panel by the TAB system receives control signals and driving voltages input from the exterior over signal lines provided on a printed circuit board (PCB) connected to the TCP. In addition, the data drive IC's are connected, in series via signal lines provided on the data PCB, to each other, and commonly receive control signals and a pixel data signal from the timing control signal and driving voltages from the power supply. The gate drive IC's are connected, in series via signal lines provided on the gate PCB, and commonly receive control signals from the timing controller and driving voltages from the power supply.

The drive IC's mounted onto the liquid crystal display panel by the COG system are connected to each other by a line on glass (LOG) system in which signal lines are mounted on the liquid crystal display panel (i.e., a lower glass substrate) and receive control signals and driving voltages from the timing controller and the power supply.

Commonly, when the drive IC's are connected to the liquid crystal display panel by the TAB system, a LOG system is adopted to eliminate the PCB, thereby permitting the manufacturing of thin liquid crystal displays. Particularly, the gate drive IC's require relatively small signal lines. The small signal lines are provided on the liquid crystal display panel by the LOG system and thereby eliminate the gate PCB. Thus, the gate drive IC's of a TAB system are connected, in series, to each other over signal lines mounted on the lower glass substrate of the liquid crystal display panel. The gate drive IC's commonly receive control signals and driving voltage signals, which are hereinafter referred to as "gate driving signals".

For instance, as shown in FIG. 1, a liquid crystal display omitting a gate PCB by utilizing LOG-type signal lines includes a liquid crystal display panel 1 and a plurality of data TCP's 8 connected between the liquid crystal display panel 1 and a data PCB 12. The liquid crystal display also includes a plurality of gate TCP's connected to other side of the liquid crystal display panel 1, data drive IC's 10 mounted in the data TCP's 8, and gate drive IC's 16 mounted in the gate TCP's 14.

The liquid crystal display panel 1 includes a lower substrate 2 provided with various signal lines and a thin film transistor array, an upper substrate 4 provided with a color filter array, and a liquid crystal injected between the lower substrate 2 and the upper substrate 4. The liquid crystal display panel 1 has a picture display area 21 consisting of liquid crystal cells provided at intersections between gate lines 20 and data lines 18 in order to display a picture. At the outer area of the lower substrate 2 located at the outer side of the picture display area 21, data pads extending from the data lines 18 and gate pads extending from the gate lines 20 are positioned. Further, a LOG-type signal line group 26 for transferring gate driving signals applied to the gate drive IC 16 is positioned at the outer area of the lower substrate 2.

The data TCP 8 is mounted with the data drive IC 10, and is provided with input pads 24 and output pads 25 electrically connected to the data drive IC 10. The input pads 24 of the data TCP 8 are electrically connected to the output pads of the data PCB 12 while the output pads 25 are electrically connected to the data pads on the lower substrate 2. Particularly, the first data TCP 8 is further provided with a gate driving signal transmission line group 22 electrically connected to the LOG-type signal line group 26 on the lower substrate 2. The gate driving signal transmission line group 22 applies gate driving signals from the timing controller and the power supply, via the data PCB 12, to the LOG-type signal line group 26.

The data drive IC's 10 convert digital pixel data signals into analog pixel voltage signals and applies the analog voltage signals to the data lines 18 on the liquid crystal display panel.

Similarly, a gate drive IC 16 is mounted on the gate TCP 14, and is provided with a gate driving signal transmission line group 28 electrically connected to the gate drive IC 16 and output pads 30. The gate driving signal transmission line group 28 is electrically connected to the LOG-type signal line group 26 on the lower substrate 2 while the output pads 30 are electrically connected to the gate pads on the lower substrate 2.

Each gate drive IC 16 sequentially applies a scanning signal such as a gate high voltage signal VGH during an interval to a gate line 20 in response to input control signals. Further, the gate drive IC 16 applies a gate low voltage signal Vgl to the gate line 20 in an interval other than the interval supplied where the gate high voltage signal VGH is supplied.

The LOG-type signal line group 26 usually includes signal lines that supply driving voltage signals from the power supply, such as a gate high voltage signal VGH and a gate low voltage signal VGL. The LOG-type signal line group 26 also includes a common voltage signal VCOM, a ground voltage signal GND and a supply voltage signal VCC. Furthermore, the LOG-type signal line group 26 has gate control signals from the timing controller, such as a gate start pulse GSP, a gate shift clock signal GSC and a gate enable signal GOE. The LOG-type signal line group 26 further includes a common line LVCOM for supplying a common voltage VCOM.

A LOG-type common line LVCOM is arranged, in parallel, in a fine pattern in a very confined narrow space like a pad portion positioned at an outer area of a picture display part 21. The LOG-type common line LVCOM is formed from a gate metal layer similar to the gate lines 20. A metal such as AlNd having a relatively large resistivity of 0.046 is usually used as the gate metal. As the LOG-type signal common line LVCOM is formed in a fine pattern within a confined area and is made from a gate metal having a relatively large resistivity value, the LOG-type signal common line LVCOM has a greater resistance than the signal lines formed from a copper film at an existent gate PCB. Because a resistance value of the LOG-type common line LVCOM is in proportion to a line length, a line resistance value increases as the LOG-type common line LVCOM extends away from the data PCB 12, thereby attenuating a gate driving signal. As a result, the common voltage VCOM transferred over the LOG-type common line LVCOM is distorted due to its line voltage value, thereby causing picture quality deterioration of a picture displayed on the picture display part 21.

This will be described in detail with reference to FIG. 2 below.

Referring to FIG. 2, a LOG-type common line LVCOM of a related art LCD is included in the LOG-type signal line group 26. The LOG-type common line LVCOM comprises a first LOG-type common line 50 provided at one edge of the liquid crystal display panel, and a second LOG-type common line 51 provided which intervenes with the first LOG-type common line 50 at the picture display area 21. The first LOG-type common line 50 consists of third to sixth LOG-type common lines 50*a* to 50*d* connected between a first data TCP 8 and the respective first to fourth gate TCP's 14A to 14D. When a liquid crystal in an in-plane switch (IPS) mode is driven with a horizontal electric field, the LOG-type common line LVCOM further includes a dummy common line 53 connected to the third to sixth LOG-type common lines 50*a* to 50*d* and to a common electrode (not shown) provided at the pixel area. On the other hand, when a liquid crystal in a twisted nematic (TN) mode is driven with a vertical electric field, the LOG-type common line LVCOM is connected to the common electrode provided at the upper substrate by a silver dot (not shown).

The third to sixth LOG-type common lines 50*a* to 50*d* have line voltage values a, b, c and d proportional to their line lengths. In addition, the third to sixth LOG-type common lines 50*a* to 50*d* are connected, via the first to fourth gate TCP's 14A to 14D, to each other in series.

In other words, the gate drive IC 16 mounted in the first gate TCP 14A is supplied with a first common voltage VCOM1 voltage-dropped in proportion to the first line resistance value a of the third LOG-type common line 50*a*. The first common voltage VCOM1 is applied, via the first gate drive IC 16, to common electrodes at a first horizontal line block A.

The gate drive IC 16 mounted in the second gate TCP 14B is supplied with a second common voltage VCOM2 voltage-dropped in proportion to the second line resistance value a+b of the third LOG-type common line 50*a* and the fourth LOG-type common line 50*b* connected to each other in series. The second common voltage VCOM2 is applied, via the second gate drive IC 16, to common electrodes at a second horizontal line block B.

The gate drive IC 16 mounted in the third gate TCP 14C is supplied with a third common voltage VCOM3 voltage-dropped in proportion to the third line resistance value a+b+c of the third to fifth LOG-type common line 50*a* to 50*c* connected to each other in series; The third common voltage VCOM3 is applied, via the third gate drive IC 16, to common electrodes at a third horizontal line block C.

The gate drive IC 16 mounted in the fourth gate TCP 14D is supplied with a fourth common voltage VCOM4 voltage-dropped in proportion to the fourth line resistance value a+b+c+d of the third to sixth LOG-type common line 50*a* to 50*d* connected to each other in series. The fourth common voltage VCOM4 is applied, via the fourth gate drive IC 16, to common electrodes at a fourth horizontal line block D. Particularly, as it goes from the first gate driving IC 16 toward the fourth gate driving IC 16, line resistance values a, b, c and d of the first and second LOG-type common lines 51 and 52 are added to each other, thereby resulting in the first to fourth common voltages VCOM1 to VCOM4 applied to the horizontal line blocks A to D having a relationship of VCOM1>VCOM2>VCOM3>VCOM4.

As the common voltages VCOM1 to VCOM4 supplied to the common electrodes are differentiated for each gate drive IC 16 in that manner, a brightness difference is generated among the horizontal line blocks A to D connected to different gate drive IC's 16. The brightness difference among the horizontal line blocks A to D results in horizontal brightness bands that cause a deterioration of picture quality.

SUMMARY OF THE INVENTION

Accordingly, it is an object of the present invention to provide a liquid crystal display device and a driving method thereof that is adaptive for preventing a brightness difference between horizontal line blocks.

In order to achieve these and other objects of the invention, a liquid crystal display device according to one embodiment of the present invention includes: a liquid crystal display panel having a liquid crystal cell matrix; a power supply generating a common voltage; common lines directly on a substrate of the liquid crystal display panel and connected to a common electrode of the liquid crystal cell; and a common voltage compensator for compensating for the common voltage using a large resistance with a value greater than a combination of resistances of the common lines and the large resistance directly between the power supply and the common lines.

A liquid crystal display device according to another embodiment of the present invention includes: a liquid crystal display panel having a plurality of data lines and a plurality of gate lines crossing each other and having liquid crystal cells arranged in a matrix; a data driving circuit group at a first side of the liquid crystal display panel and having a plurality of data integrated circuits; a first gate driving circuit group at a second side of the liquid crystal display panel and having a plurality of gate integrated circuits; a second gate driving circuit group at a third side of the liquid crystal display panel and having a plurality of gate integrated circuit; a power supply generating a common voltage; common lines directly on a substrate of the liquid crystal display panel; and a common voltage compensator compensating for the common voltage using a large resistance with a resistance value greater than a combination of resistances of the common lines and the large resistance directly between the power supply and the common lines.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawing.

Hereinafter, the preferred embodiments of the present invention will be described in detail with reference to FIGS. 3 to 6.

Figure 1:
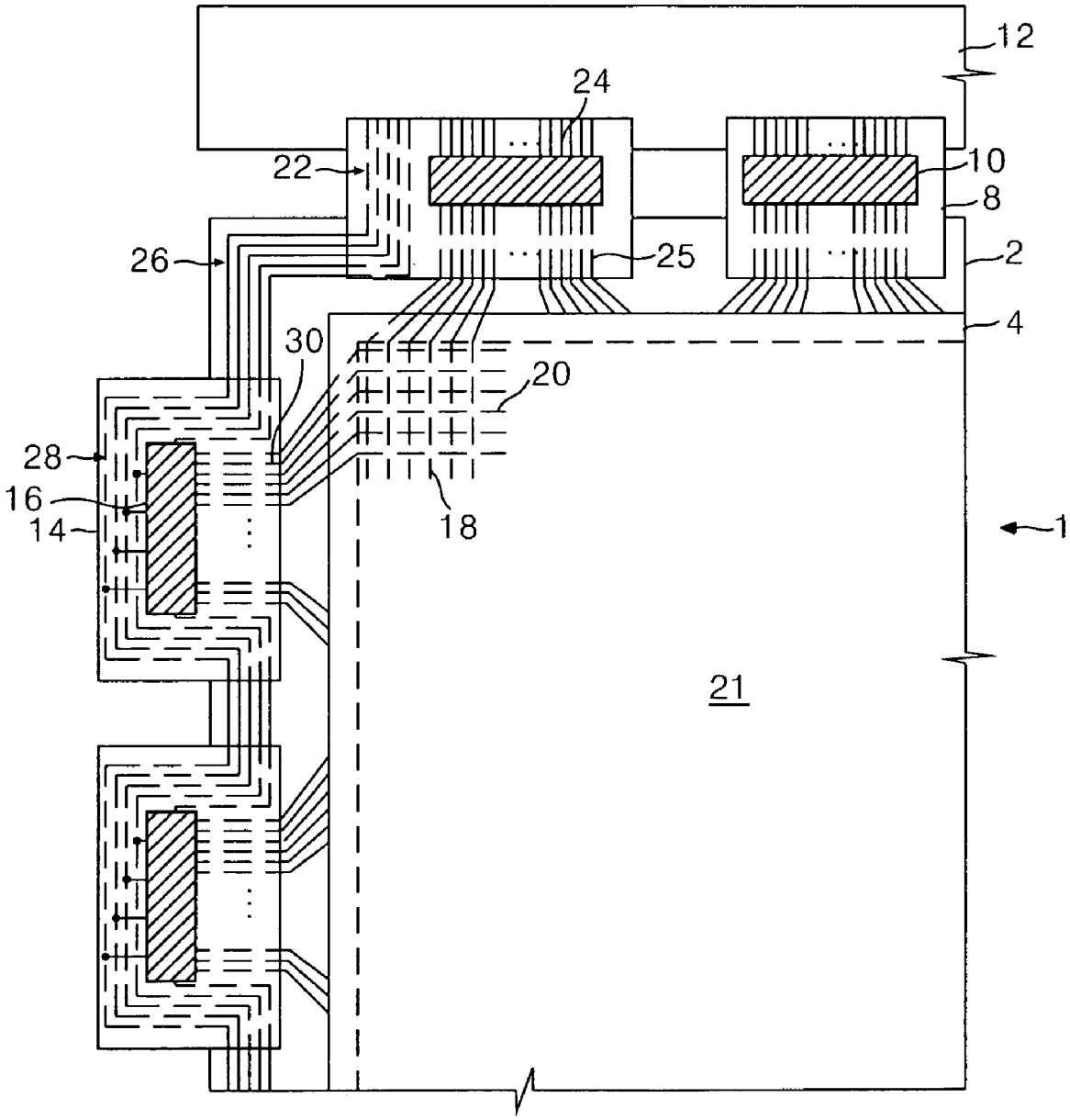
FIG. 1 RELATED ART
FIG. 1 is a schematic plan view illustrating a configuration of a conventional line on glass (LOG) type liquid crystal display device.
Figure 2:
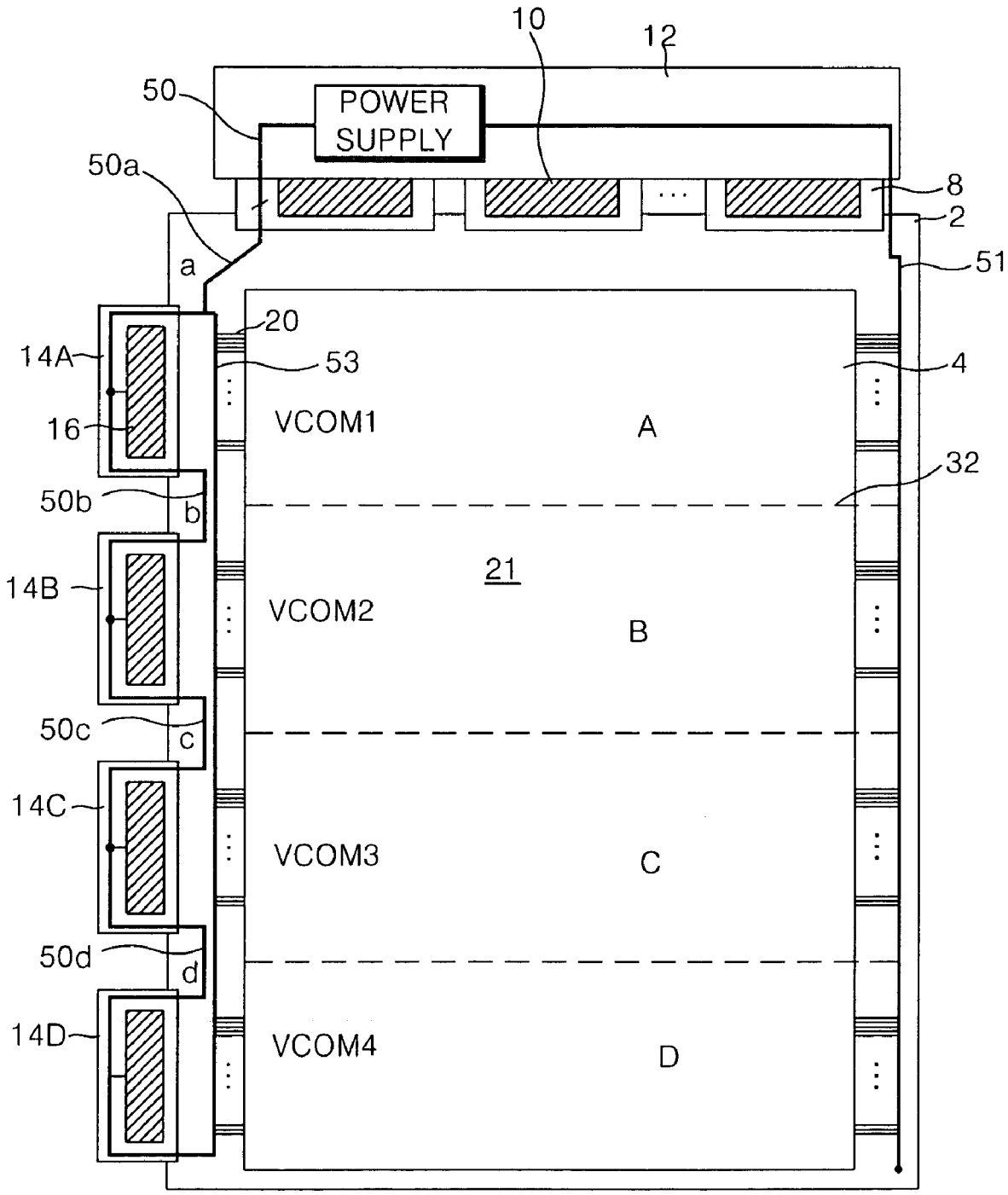
FIG. 2 RELATED ART
FIG. 2 is a view for explaining a division phenomenon between horizontal line blocks caused by a line resistance of the LOG-type common line shown in FIG. 1.
Figure 3:
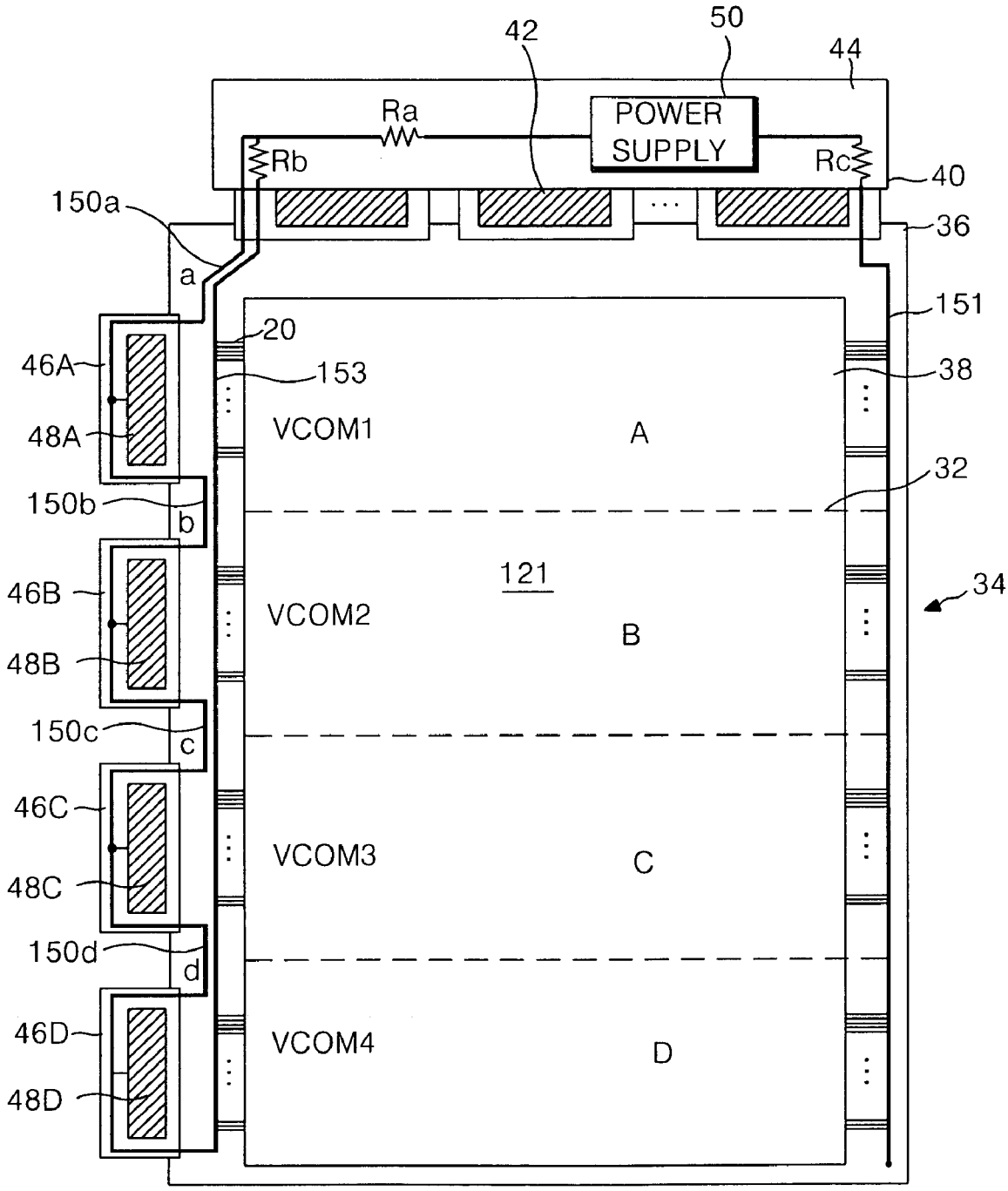
FIG. 3 is a schematic plan view illustrating a partial configuration of a LOG-type liquid crystal display device according to a first embodiment of the present invention.

FIG. 3 illustrates a liquid crystal display device according to a first embodiment of the present invention.

The liquid crystal display device according to the first embodiment of the present invention includes a liquid crystal display panel 34, a plurality of data TCP's 40 connected between the liquid crystal display panel 34 and a data PCB 44, a plurality of gate TCP's 46A to 46D connected to an adjacent side of the liquid crystal display panel 34, data drive IC's 42 mounted on the data TCP's 40, gate drive IC's 48A to 48D mounted in the gate TCP's 46A to 46D, a power supply 50 for generating driving voltages supplied to the gate drive IC's 48 and the data drive IC's 42, and a timing controller (not shown) controlling the gate drive IC's 48 and the data drive IC's 42.

The liquid crystal display panel 34 includes a lower substrate 36 provided with various signal lines and a thin film transistor array, an upper substrate 38 provided with a color filter array, and a liquid crystal injected between the lower substrate 36 and the upper substrate 38. Such a liquid crystal display panel 34 displays a picture on a picture display area 121 using liquid crystal cells provided at intersections between gate lines (not shown) and data lines (not shown). At the outer area of the lower substrate 36 located at the outer side of the picture display area 121, data pads extending from the data lines and gate pads extending from the gate lines 56 are positioned. Further, a LOG-type signal line group (not shown) for transferring gate driving signals applied to gate drive IC's 48A to 48D is positioned at the outer area of the lower substrate 36.

The data TCP 40 is mounted with the data drive IC 42, and is connected, via input and output pads connected to the data drive IC 42, to output pads of the data PCB 44 and data pads of the lower substrate 36. Particularly, the first data TCP 40 further includes a gate driving signal transmission line group (not shown) connected to the LOG-type signal line group on the lower substrate 36. The gate driving signal transmission line group applies gate driving signals from the power supply 50 and the timing controller, via the data PCB 44, to the LOG-type signal line group.

The power supply 50 generates driving voltages, such as a common voltage VCOM, a gate high voltage VGH and a gate low voltage VGL, required for the liquid crystal display device using an input power source.

The data drive IC's 42 convert digital pixel data signals into analog pixel voltage signals to apply them to the data lines on the liquid crystal display panel 34.

Similarly, gate drive IC's 48A to 48D are mounted on the gate TCP's 46A to 46D and are connected, via output pads connected to the gate drive IC's 48A to 48D, to the gate pads of the lower substrate 36.

Each gate drive IC 48A to 48D sequentially applies a scanning signal, that is, a gate high voltage signal VGH to a gate line 56 in response to input control signals. Further, each gate drive IC 48A to 48D applies a gate low voltage signal Vgl to the gate line 56 in the interval other than when the gate high voltage signal VGH is applied.

The LOG-type signal line group usually consists of LOG-type signal lines for supplying driving voltage signals from the power supply 50, such as a gate high voltage signal VGH, a gate low voltage signal VGL, a common voltage signal VCOM, a ground voltage signal GND and a supply voltage signal VCC, and LOG-type control lines for supplying gate control signals from the timing controller, such as a gate start pulse GSP, a gate shift clock signal GSC and a gate enable signal GOE. Such a LOG-type signal line group ia formed from a gate metal similar to the gate lines.

The LOG-type signal line group further includes a common line for supplying a common voltage VCOM.

The LOG-type common line consists of a first LOG-type common line 150 included in the LOG-type signal line group, and a second LOG-type common line 151 arranged in parallel to the first LOG-type common line 150 having the picture display area 121 therebetween.

Figure 4:
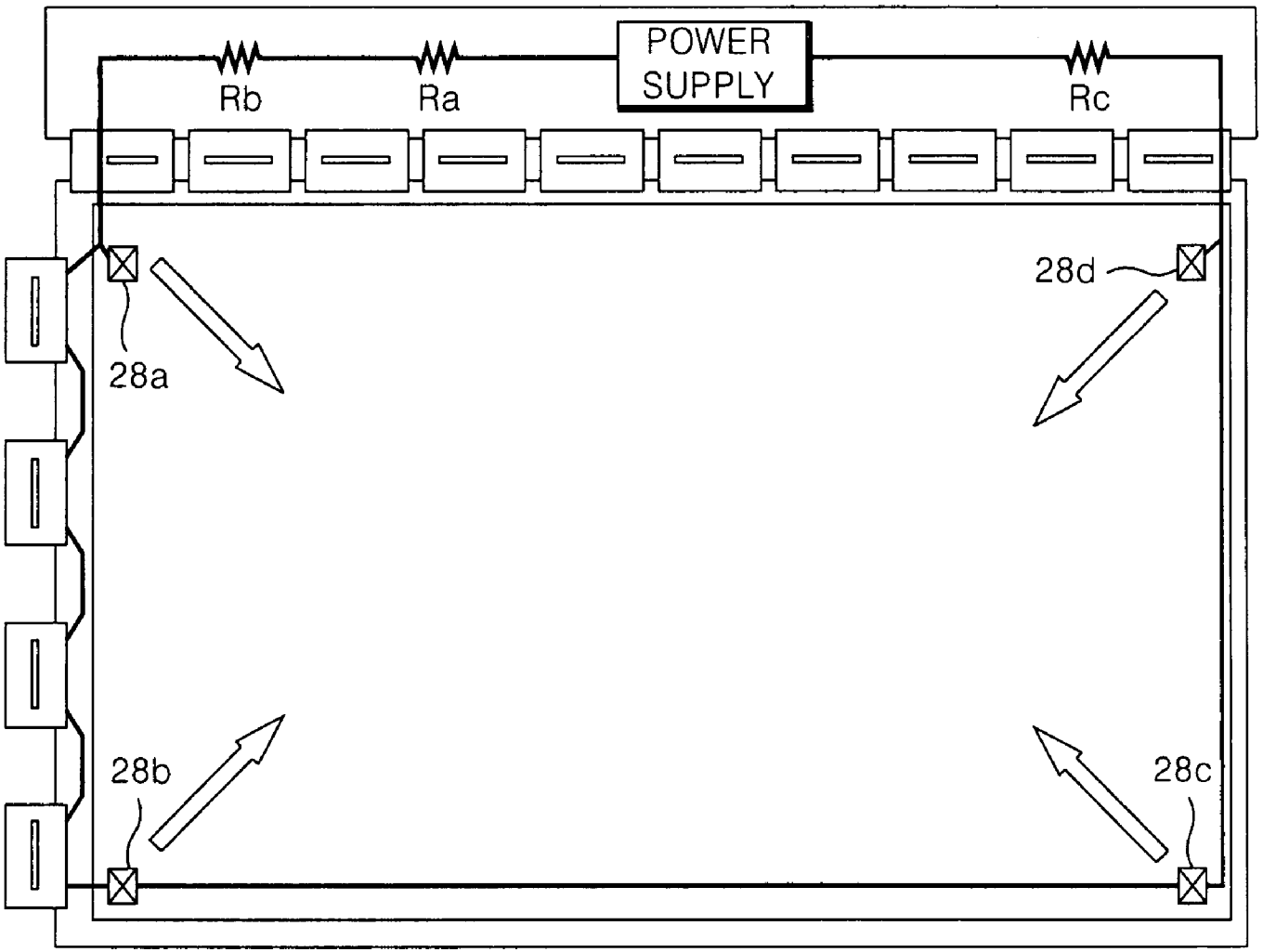
FIG. 4 depicts a silver dot for making a connection between a common line of a TN-mode liquid crystal display device and a common electrode of the upper substrate thereof.

Herein, when a liquid crystal in an in plane switch (IPS) mode is driven with a horizontal electric field, the LOG-type common line further includes a dummy common line 153 connected to the third to sixth LOG-type common lines 150*a* to 150*d* and to a common electrode (not shown) provided at the pixel area. On the other hand, when a liquid crystal in a twisted nematic (TN) mode is driven with a vertical electric field, the LOG-type common line LVCOM is connected to the common electrode provided at the upper substrate by silver dots 28*a* to 28*d* as shown in FIG. 4.

Input terminals of the first and second LOG-type common lines 150 and 151 are provided with attenuating resistors Rb and Rc having a relatively large resistance value. The attenuating resistors Rb and Rc are identical to line resistance a, b, c and d of the first and second common lines 150 and 151, so that it becomes possible to prevent a voltage difference of the common electrode for each gate drive IC 48 caused by the line resistances.

The first and second attenuating resistors Rb and Rc are connected in series to the gate driving signal output terminal of the power supply 50. Further, a dummy resistor Ra for controlling a difference of common voltages applied to the first and second common lines 150 and 151 may be provided between the first attenuating resistor Rb and the power supply.

The attenuating resistors Rb and Rc are connected in series to the line resistances a, b, c and d of the third to sixth LOG-type common lines 150*a* to 150*d* provided between the gate TCP's 46A, 46B, 46C and 46D, and has the same resistance as the total sum a+b+c+d of the line resistances a, b, c and d of the LOG-type common lines as indicated in the following equation:

$$Ra, Rc=a+b+c+d \quad (1)$$

Such attenuating resistors Ra and Rb limit the current of a common voltage signal to thereby limit the current applied to the third to sixth LOG-type common lines 150*a* to 150*d* connected in series to the attenuating resistors Rb and Rc and reduce a resistance deviation between the lines.

Reducing the current reduces the affect of the line resistances a, b, c and d of the LOG-type common lines on the voltage supplied to each gate drive IC. Thus, the gate drive IC's 48A, 48B, 48C and 48D are supplied with voltage signals having substantially the same level.

As mentioned above, in the LCD according to the first embodiment of the present invention, line resistances of the first and second common lines 150 and 151 are reduced by the attenuating resistors Rb and Rc provided at each input terminal of the first and second common lines 150 and 151, so that resistances loaded onto the input terminals of the gate drive IC's 48A, 48B, 48C and 48D become substantially equal to each other. Thus, as the substantially same common voltage signal is applied to the common electrodes to thereby prevent a brightness difference between horizontal line blocks A, B, C and D.

Figure 5:
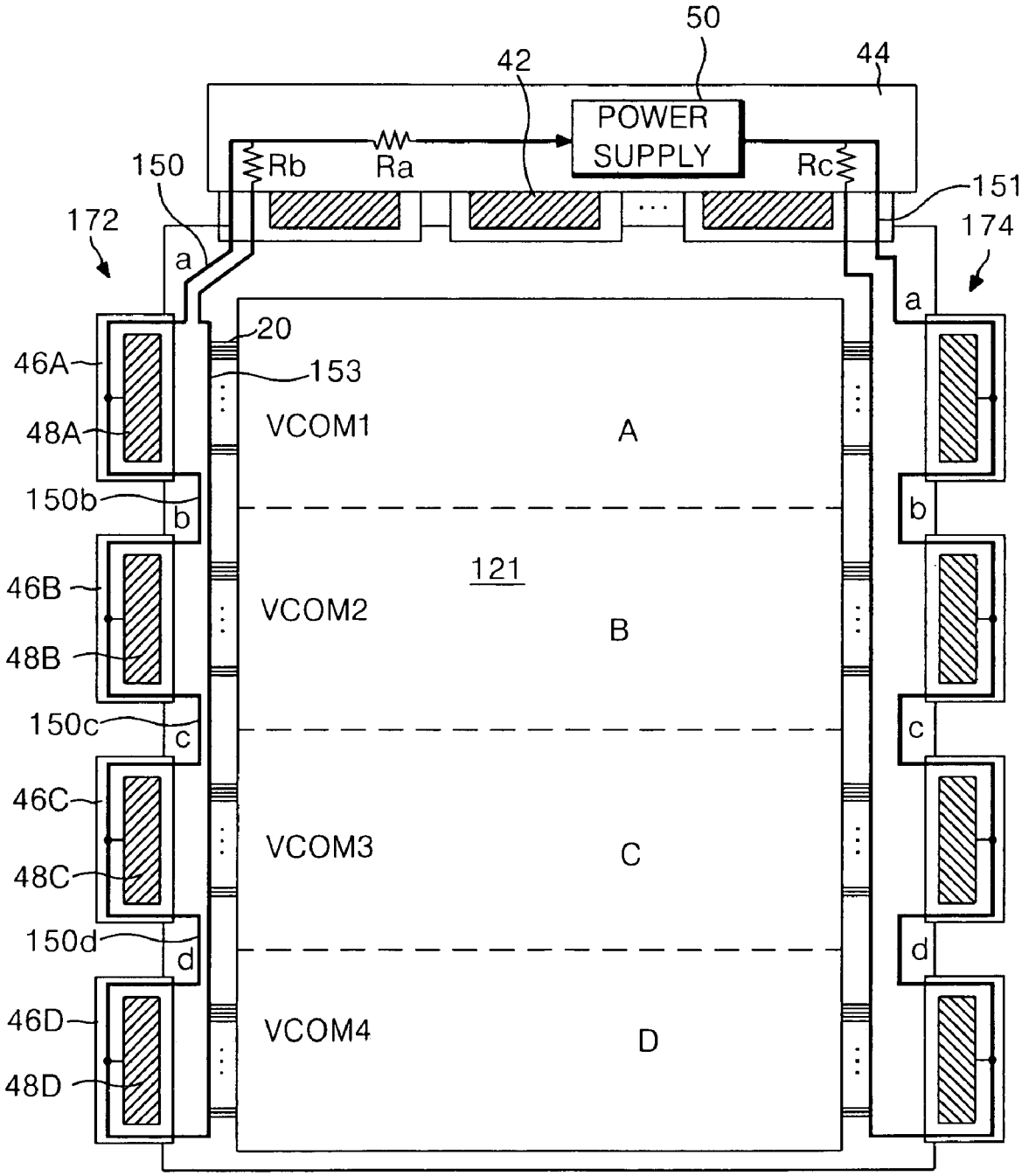
FIG. 5 is a schematic plan view illustrating a partial configuration of a LOG-type liquid crystal display device according to a second embodiment of the present invention.

FIG. 5 shows a liquid crystal display device according to a second embodiment of the present invention.

Because the liquid crystal display device shown in FIG. 5 has the same elements as the liquid crystal display device shown in FIG. 3 except that a gate drive circuit group including a plurality of gate TCP's mounted with gate drive IC's is provided at both the left and right sides of a liquid crystal display panel (hereinafter referred to as "double gate liquid crystal display device), a detailed explanation as to the elements identical to the first embodiment will be omitted.

In the double gate liquid crystal display device shown in FIG. 5, gate lines of the liquid crystal display panel are divided into the left and right sides, and a data driving circuit converts the digital data into analog gamma voltages and applies them to all the data lines and pixels in synchronization with a scanning pulse.

A first gate drive circuit group 172 at the left side sequentially applies a scanning pulse to the gate lines included in the left-half area of the liquid crystal display panel, whereas a second gate drive circuit group 174 at the right side sequentially applies a scanning pulse to the gate lines included in the right-half area of the liquid crystal display panel in synchronization with the first gate drive circuit group 172.

A LOG-type signal line group of the double gate liquid crystal display device includes a common line LVCOM for supplying a common voltage VCOM.

The LOG-type common line consists of a first LOG-type common line 150 included in the left LOG-type signal line group of the liquid crystal display panel, and a second LOG-type common line 151 arranged in parallel to the first LOG-type common line 150 with a picture display area 121 therebetween and included in the right LOG-type signal line group of the liquid crystal display panel.

Input terminals of the first and second LOG-type common lines 150 and 151 have attenuating resistors Rb and Rc with a relatively large resistance value. The attenuating resistors Rb and Rc reduce the affect of the line resistances a, b, c and d of the first and second LOG-type common lines 150 and 151 to prevent a voltage difference along the common electrode for each gate drive IC 48 caused by the line resistances.

The first and second attenuating resistors Rb and Rc are connected, in series, to the common voltage signal output terminal of the power supply and are built therein. Further, a dummy resistor Ra for controlling a difference of common voltages applied to the first and second common lines 150 and 151 may be provided between the first attenuating resistor Rb and the power supply.

The attenuating resistors Rb and Rc are connected, in series, to the line resistances a, b, c and d of the third to sixth LOG-type common lines 150*a* to 150*d* provided between the gate TCP's 46A, 46B, 46C and 46D, and has the same resistance as the total sum a+b+c+d of the line resistances a, b, c and d of the LOG-type common lines.

Such attenuating resistors Rb and Rc reduce the affect of the line resistances a, b, c and d of the LOG-type common lines on the voltage supplied to each gate drive IC. Thus, the gate drive IC's 48A, 48B, 48C and 48D are supplied with voltage signals having substantially the same level.

As mentioned above, in the LCD according to the second embodiment of the present invention, the first and second gate drive circuit groups 172 and 174 are provided at the left and right sides of the liquid crystal display panel, and line resistances of the first and second common lines 150 and 151 are reduced by the attenuating resistors Rb and Rc provided at each input terminal of the first and second common lines 150 and 151, so that resistances loaded onto the input terminals of the gate drive IC's 48A, 48B, 48C and 48D become substantially equal to each other. Thus, as the substantially same common voltage signal is applied to the common electrodes to thereby prevent a brightness difference between horizontal line blocks A, B, C and D.

Figure 6:
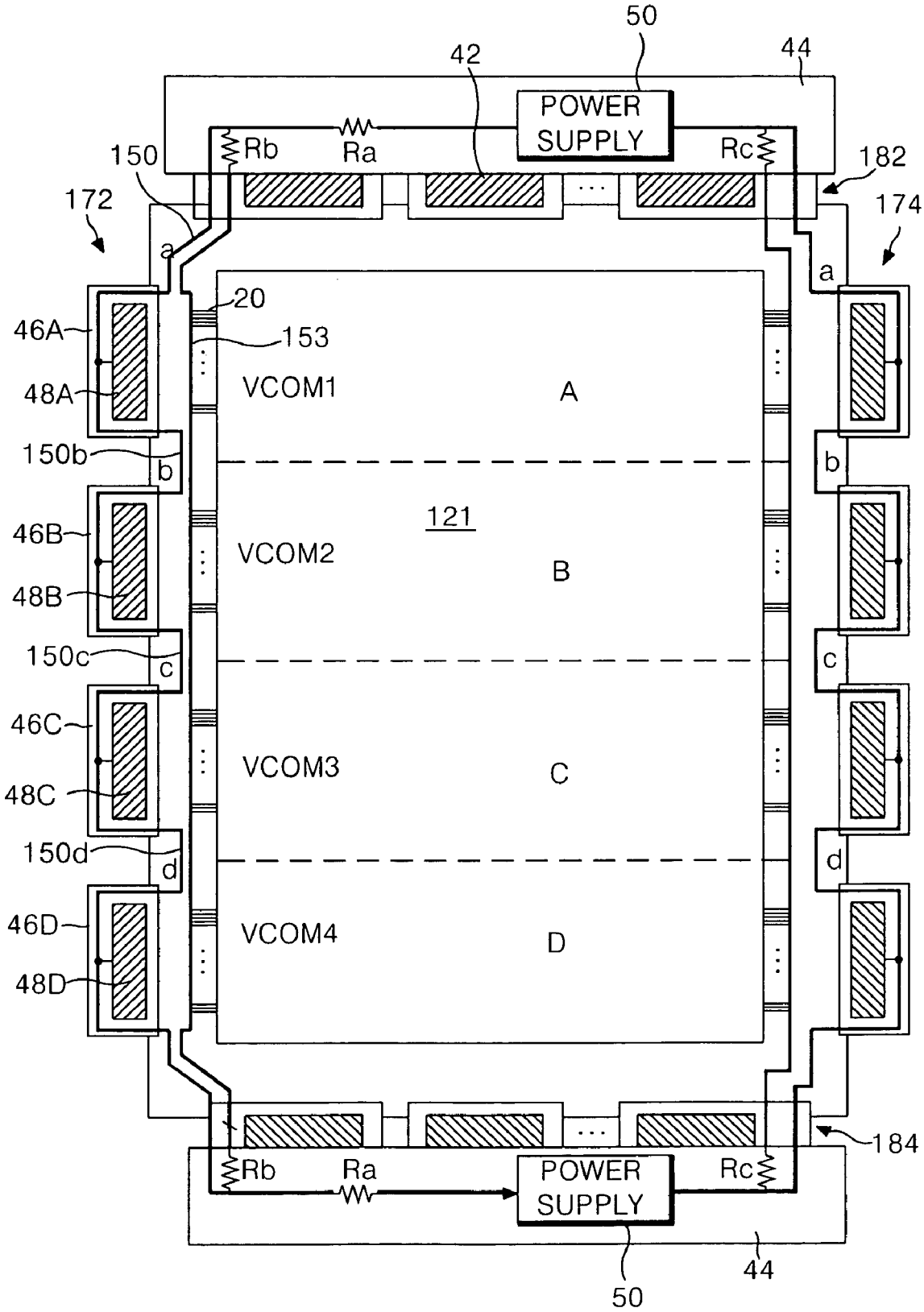
FIG. 6 is a schematic plan view illustrating a partial configuration of a LOG-type liquid crystal display device according to a third embodiment of the present invention.

FIG. 6 shows a liquid crystal display device according to a third embodiment of the present invention.

Because the liquid crystal display device shown in FIG. 6 has the same elements as the liquid crystal display device shown in FIG. 3 except that a gate drive circuit group including a plurality of gate TCP's mounted with gate drive IC's is provided at both the left and right sides of a liquid crystal display panel and the data PCB is positioned at both the upper and lower portion of a liquid crystal pattern (hereinafter referred to as "double-gate and double-source liquid crystal display device), a detailed explanation as to the elements identical to the first embodiment will be omitted.

In the double-gate and double-source liquid crystal display device shown in FIG. 6, gate lines of the liquid crystal display panel are divided into the left and right sides while data lines of the liquid crystal display panel are separated into the upper and lower portions thereof.

A first source driving circuit group 182 at the upper portion of the liquid crystal display panel converts the digital data into analog gamma voltages and applies them to all the data lines and pixels in the upper-half area in synchronization with an upper-half scanning pulse.

On the other hand, a second source driving circuit group 184 at the lower portion of the liquid crystal display panel converts the digital data into analog gamma voltages and applies them to all the data lines and pixels in the lower-half area in synchronization with an lower-half scanning pulse.

A first gate drive circuit group 172 at the left side sequentially applies a scanning pulse to the gate lines included in the left-half area of the liquid crystal display panel, whereas a second gate drive circuit group 174 at the right side sequentially applies a scanning pulse to the gate lines included in the right-half area of the liquid crystal display panel in synchronization with the first gate drive circuit group 172.

A LOG-type signal line group of the double-gate and double-source liquid crystal display device includes a common line LVCOM for supplying a common voltage VCOM.

The LOG-type common line consists of a first LOG-type common line 150 included in the left LOG-type signal line group of the liquid crystal display panel and a second LOG-type common line 151 arranged in parallel to the first LOG-type common line 150 with a picture display area 121 therebetween and included in the right LOG-type signal line group of the liquid crystal display panel.

The first and second LOG-type common lines 150 and 151 receive a common voltage from the power supply 50 positioned within the data PCB 44 provided at the upper and lower portions of the liquid crystal display panel, respectively.

Upper and lower input terminals of the first and second LOG-type common lines 150 and 151 are provided with attenuating resistors Rb and Rc having a relatively large resistance value. The attenuating resistors Rb and Rc reduce the line resistances a, b, c and d of the first and second LOG-type common lines 150 and 151, so that it becomes possible to prevent a voltage difference of the common electrode for each gate drive IC 48 caused by the line resistances.

The first and second attenuating resistors Rb and Rc are connected in series to the common voltage signal output terminal of the power supply and are built therein. Further, a dummy resistor Ra for controlling a difference of common voltages applied to the first and second common lines 150 and 151 may be provided between the first attenuating resistor Rb and the power supply.

The attenuating resistors Rb and Rc are connected in series to the line resistances a, b, c and d of the third to sixth LOG-type common lines 150*a* to 150*d* provided between the gate TCP's 46A, 46B, 46C and 46D, and has the same resistance as the total sum a+b+c+d of the line resistances a, b, c and d of the LOG-type common lines.

Such attenuating resistors Rb and Rc reduce the affect of the line resistances a, b, c and d of the LOG-type common lines on the voltage supplied to each gate drive IC. Thus, the gate drive IC's 48A, 48B, 48C and 48D are supplied with voltage signals having substantially the same level.

As mentioned above, in the LCD according to the third embodiment of the present invention, the first and second gate drive circuit groups 172 and 174 including a plurality of gate integrated circuits are provided at the left and right sides of the liquid crystal display panel and the first and second data integrated circuit groups 182 and 184 are provided at the upper and lower portions of the liquid crystal display panel, and line resistances of the first and second common lines 150 and 151 are reduced by the attenuating resistors Rb and Rc provided at each input terminal of the first and second common lines 150 and 151, so that resistances loaded onto the input terminals of the gate drive IC's 48A, 48B, 48C and 48D become substantially equal to each other. Thus, as the substantially same common voltage signal is applied to the common electrodes to thereby prevent a brightness difference between horizontal line blocks A, B, C and D.

Meanwhile, the double-gate and double-source structures in the second and third embodiments can effectively drive a liquid crystal display panel as the liquid crystal display panel increases in size, thereby permitting more effective driving of the large-dimension liquid crystal display panel.

As described above, according to the present invention, the input terminals of the LOG-type common lines are provided with resistors having a larger value than the total sum of line resistances of the LOG-type common lines. Accordingly, the line resistances of the LOG-type common lines become relatively smaller in comparison with attenuating resistors to reduce the voltage difference between gate driving signals for each gate drive integrated circuit, so that it become possible to prevent a brightness difference between the horizontal line blocks caused by the line resistance difference.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display device, comprising:

a liquid crystal display panel having a liquid crystal cell matrix;

a power supply generating a common voltage;

common lines directly on a substrate of the liquid crystal display panel and connected to a common electrode of the liquid crystal cell, wherein the common lines include a first common line at one edge of the substrate of the liquid crystal display panel and connected to one side of the common electrode and a second common line at another edge of the substrate of the liquid crystal display panel and connected to another side of the common electrode; and a common voltage compensator for compensating for the common voltage using a large resistance with a value greater than a combination of resistances of the common lines and the large resistance directly between the power supply and the common lines, wherein the common voltage compensator includes:

a first resistor having a large resistance with a value greater than a combination of resistances of the first common line between the first common line and the power supply;

a second resistor having a large resistance with a value greater than a combination of resistances of the second common line between the second common line and the power supply; and a third resistor controlling a difference of the common voltages applied to the first and second common lines between the first resistor and the second resistor.

2. The liquid crystal display device according to claim 1, further comprising a gate integrated circuit applying a scanning pulse to gate lines of the liquid crystal display panel, wherein one of the common lines is connected, via the gate integrated circuit, to the common electrode.

3. The liquid crystal display device according to claim 1, further comprising a data integrated circuit connected, via a tape carrier package, to data lines of the liquid crystal display panel to apply data signals to the data lines of the liquid crystal display panel, wherein the common line is connected, via the tape carrier package, to the common voltage compensator.

4. The liquid crystal display device according to claim 3, further comprising a printed circuit board connected to the tape carrier package, wherein the common voltage compensator is provided on the printed circuit board.

5. The liquid crystal display device according to claim 1, wherein the first common line is connected, via a gate integrated circuit applying a scanning pulse to the gate lines of the liquid crystal display panel, to the common electrode.

6. The liquid crystal display device according to claim 1, wherein the third resistor is connected between the common voltage output terminal of the power supply and the first resistor.

7. A liquid crystal display device, comprising:

a liquid crystal display panel having a plurality of data lines and a plurality of gate lines crossing each other and having liquid crystal cells arranged in a matrix;

a data driving circuit group at a first side of the liquid crystal display panel and having a plurality of data integrated circuits;

a first gate driving circuit group at a second side of the liquid crystal display panel and having a plurality of gate integrated circuits;

a second gate driving circuit group at a third side of the liquid crystal display panel and having a plurality of gate integrated circuit;

a power supply generating a common voltage;

common lines directly on a substrate of the liquid crystal display panel, wherein the common lines include a first common line connected, via the gate integrated circuits of the first gate driving circuit group, to the common electrode and a second common line connected, via the gate integrated circuits of the second gate driving circuit group to the common electrode; and a common voltage compensator compensating for the common voltage using a large resistance with a resistance value greater than a combination of resistances of the common lines, wherein and the large resistance directly between the power supply and the common lines, wherein the common voltage compensator includes:

a first resistor having a large resistance with a value greater than a combination of resistances of the first common line between the first common line and the power supply;

a second resistor having a large resistance with a value greater than a combination of resistances of the second common line between the second common line and the power supply; and a third resistor controlling a difference of the common voltages applied to the first and second common lines between the first resistor and the second resistor.

8. The liquid crystal display device according to claim 7, wherein the common lines are connected, via a tape carrier package mounted with the data integrated circuits, to the common voltage compensator.

9. The liquid crystal display device according to claim 7, further comprising a printed circuit board connected to the data driving circuit group, wherein the common voltage compensator is provided on the printed circuit board.

10. The liquid crystal display device according to claim 7, further comprising a second data driving circuit group provided at a fourth side of the liquid crystal display panel and having a plurality of data integrated circuits.

* * * * *